US010156230B2

(12) United States Patent
Miyauchi

(10) Patent No.: US 10,156,230 B2
(45) Date of Patent: Dec. 18, 2018

(54) DIAPHRAGM TYPE FUEL PUMP FOR GENERAL PURPOSE ENGINE

(71) Applicant: HONDA MOTOR CO., LTD., Tokyo (JP)

(72) Inventor: Tomohiro Miyauchi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 169 days.

(21) Appl. No.: 15/454,467

(22) Filed: Mar. 9, 2017

(65) Prior Publication Data

US 2017/0260975 A1 Sep. 14, 2017

(30) Foreign Application Priority Data

Mar. 14, 2016 (JP) ..... 2016-049628

(51) Int. Cl.
*F04B 43/02* (2006.01)
*F02M 37/04* (2006.01)
*F15B 15/10* (2006.01)

(52) U.S. Cl.
CPC ..... *F04B 43/023* (2013.01); *F02M 37/046* (2013.01); *F04B 43/02* (2013.01); *F15B 15/10* (2013.01)

(58) Field of Classification Search
CPC ..... F04B 1/0426; F04B 53/14; F04B 43/02; F02M 37/046; F02M 37/06
See application file for complete search history.

(56) References Cited

U.S. PATENT DOCUMENTS 6,171,081 B1 * 1/2001 Nakajima ..... F02M 37/046 417/437
6,338,295 B1 * 1/2002 Kubota ..... F04B 43/02 417/413.1
6,513,504 B2 * 2/2003 Ikuma ..... F02B 61/045 123/508
6,655,933 B2 * 12/2003 Chiba ..... F04B 1/0426 417/470
2002/0166543 A1 11/2002 Ikuma

FOREIGN PATENT DOCUMENTS

JP 4563613 8/2010

* cited by examiner

*Primary Examiner* — Thomas E Lazo
(74) *Attorney, Agent, or Firm* — Rankin, Hill & Clark LLP

(57) ABSTRACT

A diaphragm type fuel pump includes a rod, one end of which is coupled to a diaphragm, a plunger which is slidably fitted with respect to the other end of the rod, and a plunger biasing member which biases the plunger toward the other end of the rod. The other end of the rod has a first pin extending outward radially. A through hole extends through the plunger in a radial direction. The through hole has a size which allows the first pin to move in a longitudinal direction of the rod. The first pin is in contact with one edge of the through hole. A gap is formed between another edge of the through hole and another end surface of the rod. A second pin in parallel to the first pin can be fitted into the gap.

3 Claims, 6 Drawing Sheets

DIAPHRAGM TYPE FUEL PUMP FOR GENERAL PURPOSE ENGINE

CROSS-REFERENCE TO RELATED APPLICATION

This application is based upon and claims the benefit of priority from Japanese Patent Application No. 2016-049628 filed on Mar. 14, 2016, the contents of which are incorporated herein by reference.

BACKGROUND OF THE INVENTION

Field of the Invention

The present invention relates to a technique of improving a diaphragm type fuel pump for a general purpose engine.

Description of the Related Art

A fuel pump used in a fuel supply line for an engine mounted in a vehicle is made up of an electrical pump such as a solenoid pump. However, in most cases, the general purpose engine does not have any battery. Therefore, the fuel pump used in such a general purpose engine cannot receive supply of electrical energy at the time of starting operation of the general purpose engine. The fuel pump needs to be a mechanical pump for making it possible to supply a fuel at the time of starting operation of the engine.

The mechanical pump supplies the fuel to the general purpose engine from a fuel tank provided outside the general purpose engine. The mechanical pump is driven by a camshaft of the general purpose engine. For example, the mechanical pump is a diaphragm type fuel pump. For example, a diaphragm type fuel pump disclosed in Japanese Patent No. 4563613 (Patent Document 1) is known.

The diaphragm type fuel pump for the general purpose engine includes a housing, a diaphragm, a rod, a plunger, and a plunger biasing member. The diaphragm divides a space inside the housing into a pump chamber and an air chamber. One end of the rod is coupled to the diaphragm, and the other end of the rod protrudes from the air chamber to the outside of the housing. The rod is slidably supported by the housing. The plunger is positioned concentrically with the other end of the rod, and slidably fitted with respect to the rod. Further, the plunger biasing member biases the plunger toward the other end of the rod.

The other end of the rod includes a pin extending in a radially outward direction of the other end. The plunger includes a bottomed tubular shape having a tubular portion. The other end of the rod can be fitted into the tubular portion. A long hole extends through the tubular portion in a radial direction. The long hole is elongated in the longitudinal direction of the plunger. A pin contacts one part of the edge of the long hole closer to the diaphragm.

The discharge pressure of the fuel pump is a relatively low pressure which depends on the biasing force of the diaphragm biasing member. The diaphragm biasing member biases the diaphragm from the air chamber to the pump chamber.

In this regard, even in the case of a general purpose engine which does not have any battery, it may be preferable to provide an electronic fuel injection apparatus. Since the electronic fuel injection apparatus injects a fuel at high pressure, in comparison with the case of a carburetor which atomizes the fuel utilizing the negative pressure, the state of atomization can be controlled easily. The discharge pressure of the fuel pump for supplying the fuel to the electronic fuel injection apparatus needs to be a high pressure.

However, the discharge pressure of the diaphragm type fuel pump for the general purpose engine disclosed in the above Patent Document 1 is a low pressure. It is necessary to increase the biasing force of the diaphragm biasing member for allowing the discharge pressure to become the high pressure. However, if the biasing force of the diaphragm biasing member becomes excessively high, the speed of the elastic displacement of the diaphragm cannot follow the displacement speed of a cam nose provided in a camshaft of the general purpose engine. Therefore, there is a limit on increase in the discharge pressure of the diaphragm type fuel pump for the general purpose engine. There is a room of improvement in performing atomization of the fuel properly by the electronic fuel injection apparatus.

In this regard, in the diaphragm type fuel pump for the general purpose engine, it may be considered to directly connect the other end of the rod to the plunger, or form the plunger integrally with the other end of the rod. When the plunger is pushed up by the cam of the general purpose engine, the diaphragm is forcibly displaced elastically toward the pump chamber by the plunger. Therefore, the resulting discharge pressure of the fuel pump becomes relatively high.

However, in the case of simply adopting a structure where the plunger is directly connected to the other end of the rod, or the plunger is formed integrally with the other end of the rod, the structure becomes complicated. Further, the cost of the diaphragm type fuel pump becomes high. Further, the diaphragm type fuel pump for the general purpose engine to be used in the low pressure application and the diaphragm type fuel pump for the general purpose engine to be used in the high pressure application need to be produced individually. Consequently, the diaphragm type fuel pump for the general purpose engine to be used in the low pressure application and the diaphragm type fuel pump for the general purpose engine to be used in the high pressure application may have different shapes and sizes. There is a room of further improvement in this regard.

SUMMARY OF THE INVENTION

A general object of the present invention is to provide a diaphragm type fuel pump for a general purpose engine in which the same diaphragm type fuel pump for the general purpose engine can be easily switched between a low pressure application and a high pressure application.

In the first invention, a diaphragm type fuel pump for a general purpose engine includes a housing, a diaphragm configured to divide a space inside the housing into a pump chamber and an air chamber, a rod slidably supported by the housing and which has one end coupled to the diaphragm and the other end protruding from the air chamber to the outside of the housing, a plunger positioned concentrically with the other end of the rod and configured to be slidably fitted with respect to the rod, and a plunger biasing member configured to bias the plunger toward the other end of the rod.

The other end of the rod includes a first pin extending radially outwardly of the other end. The plunger includes a bottomed tubular shape having a tubular portion, and the other end of the rod is fitted into the tubular portion. A through hole extends through the tubular portion in a radial direction thereof. The through hole is configured to have a size which allows the first pin to be displaced in a longitudinal direction of the rod relative to the through hole. A part of an edge of the through hole closer to the diaphragm is referred to as one edge, and another part thereof closer to a bottom of the plunger is referred to as the other edge. The first pin is in contact with the one edge.

A gap is formed between the other edge of the through hole and the other end surface of the rod for allowing a second pin in parallel to the first pin to be fitted into the gap. The second pin is fitted into the gap to restrict movement of the other end of the rod in a longitudinal direction of the rod relative to the plunger by the first pin and the second pin.

As described above, in the first invention, the diaphragm type fuel pump can include, in addition to the first pin, the second pin which is in parallel to the first pin. Regardless of the presence or absence of the second pin, the plunger is biased toward the other end of the rod by the plunger biasing member. The first pin is in contact with the part of the edge (one edge) of the through hole closer to the diaphragm at all times. In the case where only the first pin is used, the other end of the rod can move in the longitudinal direction of the rod relative to the plunger. In this case, a diaphragm biasing member configured to bias the diaphragm from the air chamber toward the pump chamber is provided. Therefore, when the plunger is pushed up toward the diaphragm by the cam of the general purpose engine, the diaphragm is biased by the diaphragm biasing member toward the pump chamber. The resulting discharge pressure of the fuel pump is a relatively low pressure which depends on the biasing force of the diaphragm biasing member.

On the other hand, in the case where both of the first pin and the second pin are used, the second pin is interposed between a part of the edge of the through hole closer to a bottom of the plunger (the other edge) and the other end surface of the rod, and is in contact with both of the other edge and the other end surface. That is, the second pin is in contact with the part of the edge (other edge) of the through hole adjacent to the bottom of the plunger. Movement of the other end of the rod in the longitudinal direction of the rod relative to the plunger is restricted (i.e., locked) by the first pin and the second pin. As a result, the rod is directly connected to the plunger, regardless of whether or not the diaphragm biasing member is present. Therefore, when the plunger is pushed up toward the diaphragm by the cam of the general purpose engine, the diaphragm is forcibly displaced elastically toward the pump chamber by the plunger. Therefore, the resulting discharge pressure of the fuel pump is a relatively high pressure which does not depend on the biasing force of the diaphragm biasing member.

In this manner, the discharge pressure of the fuel pump can be changed optionally depending on whether or not the second pin is present. Further, simply by selecting the presence or absence of the second pin, with the simple structure, the discharge pressure of the fuel pump can be changed very easily. Additionally, even if the discharge pressure of the fuel pump is changed, the shape and the dimensions of the fuel pump remain exactly the same. That is, simply by switching between the fuel pump for use in the low pressure application and the fuel pump for use in the high pressure application, the pump can be used as is, without any modification. Therefore, in the fuel supply line of the general purpose engine, it is possible to easily switch between the line having the specifications for the carburetor and the line having the specifications for the electronic control injection apparatus. Further, merely by selecting the presence or the absence of the second pin, one type of diaphragm type fuel pump can be switched between the low pressure application and the high pressure application. Therefore, improvement in the mass production efficiency is achieved. Consequently, it becomes possible to reduce the cost of the diaphragm type fuel pump for the general purpose engine.

Preferably, a spacer is fitted between the second pin and the inner bottom of the plunger. In the structure, the central portion of the second pin in the longitudinal direction can be supported by the inner bottom of the plunger through the spacer. Therefore, it is possible to enhance the bending strength of the second pin.

Further, in the second invention, a diaphragm type fuel pump for a general purpose engine includes a housing, a diaphragm configured to divide a space inside the housing into a pump chamber and an air chamber, a rod slidably supported by the housing and which has one end coupled to the diaphragm and the other end protruding from the air chamber to the outside of the housing, a plunger positioned concentrically with the other end of the rod and configured to be slidably fitted with respect to the rod, and a plunger biasing member configured to bias the plunger toward the other end of the rod.

The other end of the rod includes a first pin extending radially outwardly of the other end. The plunger includes a bottomed tubular shape having a tubular portion, and the other end of the rod is fitted into the tubular portion. A through hole extends through the tubular portion in a radial direction thereof. The through hole is configured to have a size which allows the first pin to be displaced in a longitudinal direction of the rod relative to the through hole. A part of the edge of the through hole closer to the diaphragm is in contact with the first pin.

A gap is formed between the other end surface of the rod and an inner bottom of the plunger, for allowing the spacer to be fitted into the gap. The spacer is fitted into the gap to restrict movement of the other end of the rod in a longitudinal direction of the rod relative to the plunger by the first pin and the spacer.

As described above, in the second embodiment, the diaphragm type fuel pump can include the spacer in addition to the first pin. Regardless of the presence or absence of the spacer, the plunger is biased toward the other end of the rod by the plunger biasing member. The first pin is in contact with the part of the edge (one edge) of the through hole closer to the diaphragm at all times. In the case where only the first pin is used, the other end of the rod can move in the longitudinal direction of the rod relative to the plunger. In this case, a diaphragm biasing member configured to bias the diaphragm from the air chamber toward the pump chamber is provided. Therefore, when the plunger is pushed up toward the diaphragm by the cam of the general purpose engine, the diaphragm is biased by the diaphragm biasing member toward the pump chamber. The resulting discharge pressure of the fuel pump is a relatively low pressure which depends on the biasing force of the diaphragm biasing member.

On the other hand, in the case where both of the first pin and the spacer are used, the spacer is interposed between the other end surface of the rod and the inner bottom of the plunger, and comes into contact with both of the other end surface and the inner bottom. Movement of the other end of the rod in the longitudinal direction of the rod relative to the plunger is restricted (i.e., locked) by the first pin and the spacer. As a result, the rod is directly connected to the plunger, regardless of whether or not the diaphragm biasing member is present. Therefore, when the plunger is pushed up toward the diaphragm by the cam of the general purpose engine, the diaphragm is forcibly displaced elastically toward the pump chamber by the plunger. Therefore, the discharge pressure of the fuel pump is a relatively high pressure which does not depend on the biasing force of the diaphragm biasing member.

In this manner, depending on whether the spacer is present or not, it is possible to optionally change the discharge pressure of the fuel pump. Further, simply by selecting the presence or the absence of the spacer, with the simple structure, it is possible to change the discharge pressure very easily. Additionally, even in the case that the discharge pressure of the fuel pump is changed, the shape and the dimensions of the fuel pump remain exactly the same. That is, simply by switching between the fuel pump for use in the low pressure application and the fuel pump for use in the high pressure application, the pump can be used as is, without any modification. Therefore, in the fuel supply line of the general purpose engine, it is possible to easily switch between the line having the specifications for the carburetor and the line having the specifications for the electronic control injection apparatus. Further, by selecting the presence or the absence of the second pin, the same diaphragm type fuel pump can be switched between the low pressure application and the high pressure application. Therefore, improvement in the mass production efficiency is achieved. Consequently, it becomes possible to reduce the cost of the diaphragm type fuel pump for the general purpose engine.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
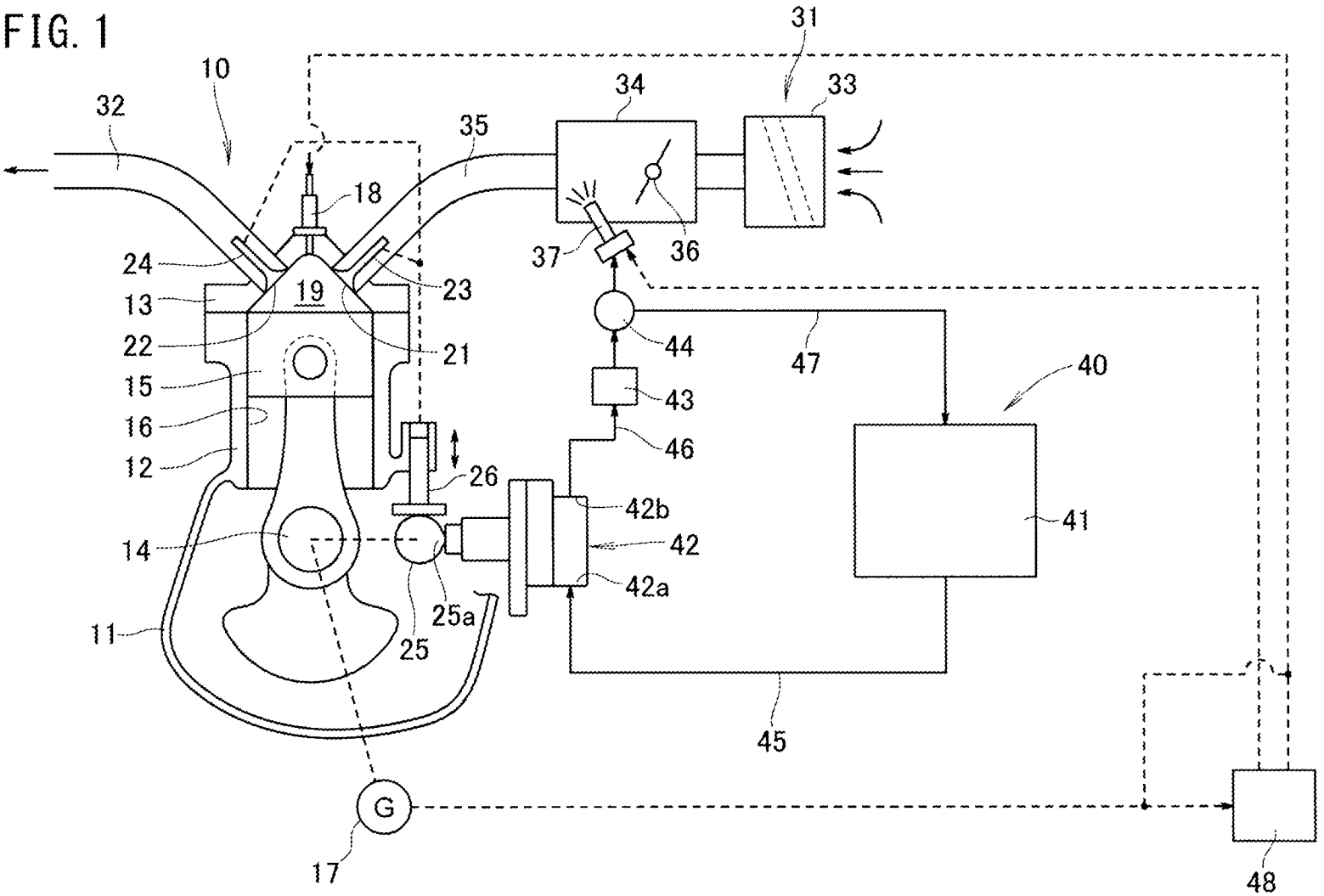
FIG. 1 is a diagram schematically showing an air intake line, an air discharge line, and a fuel supply line of a general purpose engine having a diaphragm type fuel pump for the general purpose engine according to the present invention.

A general purpose engine 10 is, e.g., mounted in a general purpose machine such as an outboard engine or a work machine. As shown in FIG. 1, the general purpose engine 10 includes a crankcase 11, a cylinder block 12, a head cover 13, a crankshaft 14, and a piston 15. The cylinder block 12 has a cylinder 16 where the piston 15 moves back and forth in a reciprocal manner. Further, the general purpose engine 10 includes a power generator 17 driven by the crankshaft 14. FIG. 1 schematically shows an air intake line 31, an air discharge line 32, and a fuel supply line 40 of the general purpose engine 10.

An ignition plug 18 is attached to the head cover 13. Further, the head cover 13 includes an air intake port 21 and an air discharge port 22. The air intake port 21 is opened/closed by an air intake valve 23, and the air discharge port 22 is opened/closed by an air discharge valve 24. The air intake valve 23 and the air discharge valve 24 are opened/closed by a rocker arm shaft 25 through a valve rocker arm 26. The rocker arm shaft 25 is a type of a camshaft, and driven by the crankshaft 14. Hereinafter, the rocker arm shaft 25 will be referred to as the "camshaft 25" as necessary.

The air intake line 31 is connected to the air intake port 21, and the air discharge line 32 is connected to the air discharge port 22. The air intake line 31 includes an air cleaner 33, a throttle body 34, and an intake manifold 35. A throttle valve 36 and an electronic control injection apparatus 37 are installed in the throttle body 34.

The fuel supply line 40 includes a fuel tank 41, a diaphragm type fuel pump 42 for the general purpose engine, a fuel filter 43, a fuel pressure regulator 44, and the electronic control injection apparatus 37. The diaphragm type fuel pump 42 for the general purpose engine (hereinafter simply referred to as the fuel pump 42) is a type of a mechanical fuel pump driven by a cam 25*a* (cam nose 25*a*) of the camshaft 25.

The fuel in the fuel tank 41 is supplied to an intake port 42*a* of the fuel pump 42 by a fuel intake pipe 45. The fuel discharged from a discharge port 42*b* of the fuel pump 42 flows through a fuel discharge pipe 46, and then, the fuel is supplied to the electronic control injection apparatus 37 through the fuel filter 43 and the fuel pressure regulator 44. The fuel atomized by the electronic control injection apparatus 37 is supplied into the throttle body 34, and supplied to a combustion chamber 19 of the general purpose engine 10 together with combustion air.

The fuel discharged from the fuel pump 42 pulsates. The fuel pressure regulator 44 levels (equalizes) the discharge pressure of the fuel. The redundant fuel is returned to the fuel tank 41 through a return pipe 47.

A control unit 48 receives electrical energy from the power generator 17, and at least controls the ignition plug 18 and the electronic control injection apparatus 37.

Figure 2:
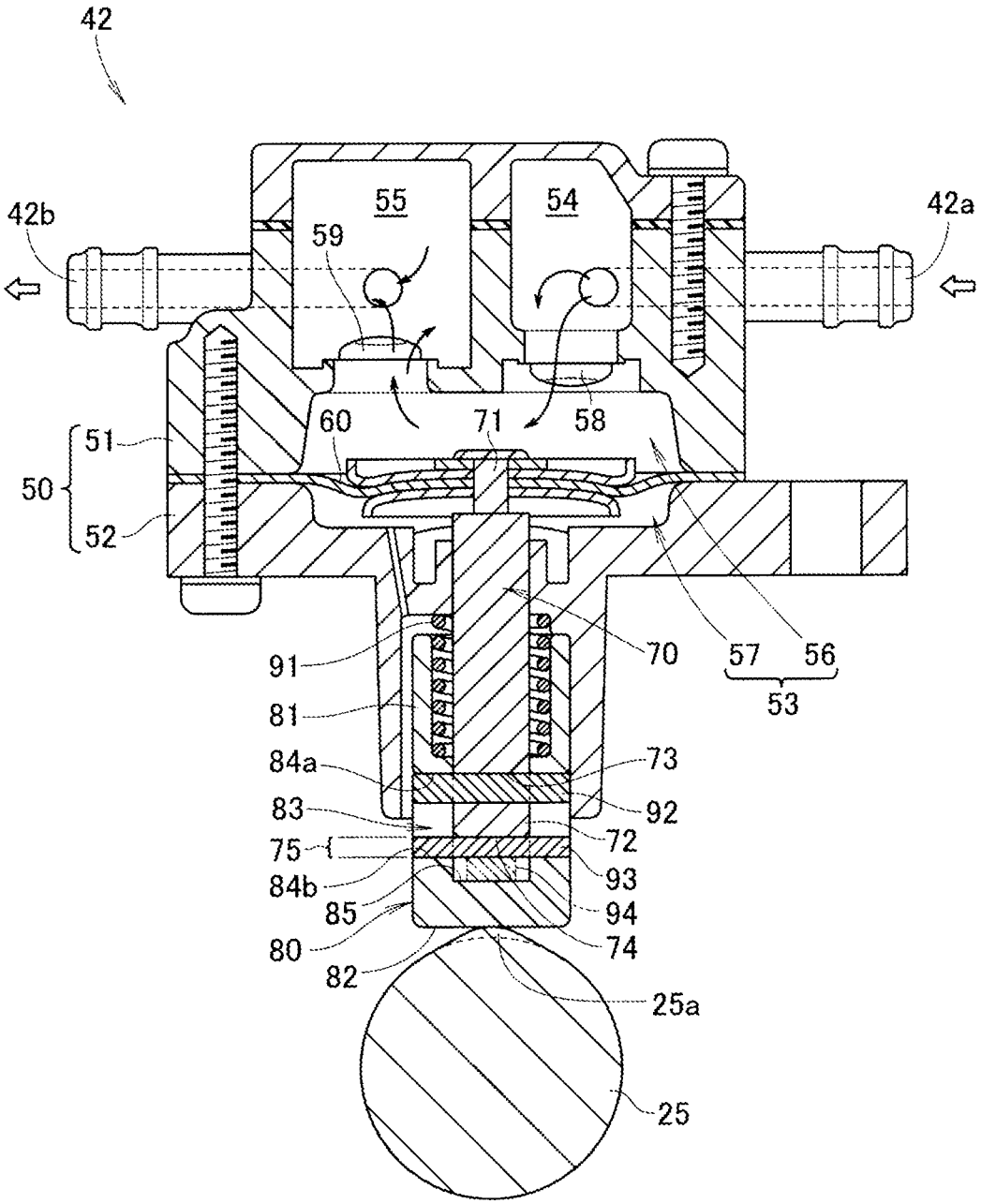
FIG. 2 is a cross sectional view showing the diaphragm type fuel pump for the general purpose engine used in a high pressure application shown in FIG. 1.
Figure 3:
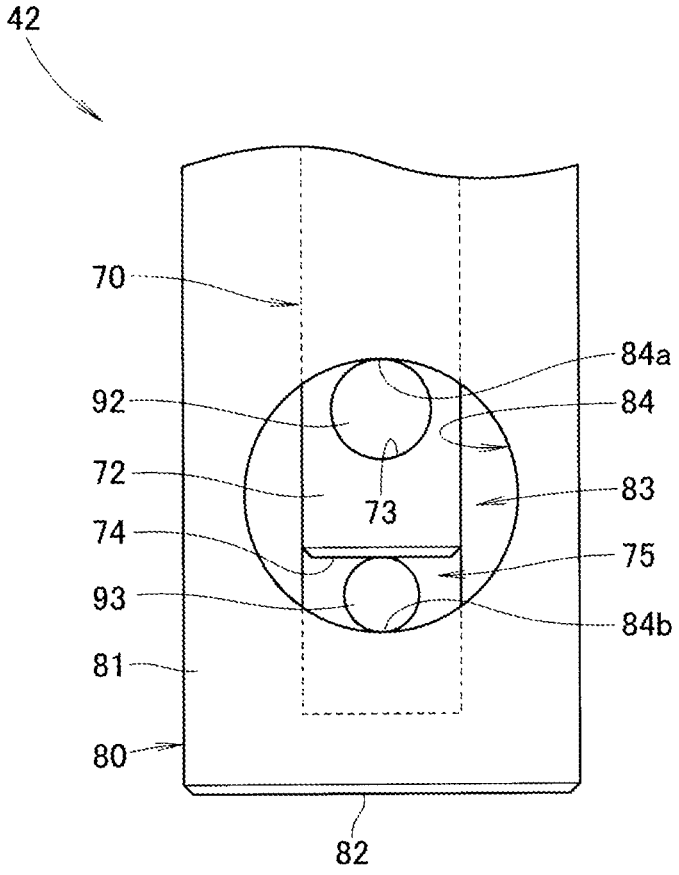
FIG. 3 is an enlarged view showing the other end of a rod and a plunger shown in FIG. 2, as viewed in a longitudinal direction of a first pin.

As shown in FIGS. 2 and 3, the diaphragm type fuel pump for the general purpose engine (fuel pump) 42 is used as a fuel pump in a "high pressure" application. The fuel pump 42 includes a housing 50, a diaphragm 60, a rod 70, a plunger 80, a plunger biasing member 91, and a first pin 92.

The housing 50 includes two separate bodies, i.e., a first housing half body 51 and a second housing half body 52, which are fixed together by bolts. The housing 50 includes a diaphragm chamber 53, an intake chamber 54, a discharge chamber 55, the intake port 42*a*, and the discharge port 42*b*. The diaphragm chamber 53 is formed between the first housing half body 51 and the second housing half body 52. All of the intake chamber 54, the discharge chamber 55, the intake port 42*a*, and the discharge port 42*b* are formed in the first housing half body 51.

The diaphragm 60 is provided between the first housing half body 51 and the second housing half body 52, i.e., in the diaphragm chamber 53. The diaphragm 60 divides the diaphragm chamber 53 (a space 53 inside the housing 50) into a pump chamber 56 and an air chamber 57.

The air chamber 57 communicates with external air. The pump chamber 56 communicates with the intake port 42*a* through the intake chamber 54 and an intake check valve 58, and communicates with the discharge port 42*b* through the discharge chamber 55 and a discharge check valve 59. The intake check valve 58 allows only the fuel to flow from the intake chamber 54 to the pump chamber 56. The discharge check valve 59 allows only the fuel to flow from the pump chamber 56 to the discharge chamber 55.

The rod 70 is slidably supported by the second housing half body 52 (housing 50). One end 71 of the rod 70 is coupled to the diaphragm 60, and the other end 72 of the rod 70 protrudes from the air chamber 57 to the outside of the second housing half body 52 (housing 50), i.e., toward the cam 25*a*.

The plunger 80 has a bottomed tubular shape including a tubular portion 81. The other end 72 of the rod 70 can be fitted into the tubular portion 81. A bottom 82 of the plunger 80 faces the cam 25*a*. The plunger 80 is positioned coaxially with the other end 72 of the rod 70, and fitted with respect to the rod 70 slidably relative to the rod 70.

The plunger biasing member 91 comprises a compression coil spring wound around the rod 70, and the plunger biasing member 91 biases the plunger 80 toward the other end 72 of the rod 70 (i.e., toward the cam 25*a*).

The first pin 92 is provided at the other end 72 of the rod 70, and extends radially outwardly of the other end 72. That is, a pin fitting hole 73 extends through the other end 72 of the rod 70 in the radial direction. The first pin 92 is fitted into the pin fitting hole 73, and extends both in opposite radial directions of the rod 70.

A through hole 83 extends through the tubular portion 81 of the plunger 80 in the radial direction. The through hole 83 is formed to have a size which allows the first pin 92 to be displaced relative to the through hole 83 in the longitudinal direction of the rod 70. The through hole 83 is a perfectly circular hole. It should be noted that the through hole 83 may be a long hole elongated in the longitudinal direction of the plunger 80.

A part 84*a* of an edge 84 of the through hole 83 closer to the diaphragm 60 will be referred to as the "one edge 84*a*", and another part 84*b* thereof closer to the bottom 82 of the plunger 80 will be referred to as the "other edge 84*b*". The first pin 92 is in contact with the one edge 84*a*.

A gap 75 is formed between the other edge 84*b* of the through hole 83 and an end surface 74 (the other end surface 74) of the other end 72 of the rod 70. A second pin 93 in parallel to the first pin 92 can be fitted into the gap 75. By adopting a structure where the second pin 93 is fitted into the gap 75, movement of the other end 72 of the rod 70 in the longitudinal direction of the rod 70 relative to the plunger 80 is restricted by the first pin 92 and the second pin 93. Preferably, the length of the first and second pins 92, 93 is equal to or less than the outer diameter of the tubular portion 81 of the plunger 80.

In operation of the fuel pump 42 used in the high pressure application, the plunger 80 moves back and forth in a reciprocal manner relative to the diaphragm 60 in accordance with rotational displacement of the cam 25*a*. Thus, the rod 70 locked to the plunger 80 moves back and forth in a reciprocal manner together with the plunger 80 to thereby displace the diaphragm 60 elastically. Consequently, the volume of the pump chamber 56 is changed, and the fuel suctioned from the intake port 42*a* is discharged to the discharge port 42*b*.

As described above, the diaphragm type fuel pump 42 for the general purpose engine used as the fuel pump in the "high pressure" application is the optimum for supplying the fuel to the "electronic fuel injection apparatus 37 for injecting the fuel at high pressure (see FIG. 1)".

Figure 4:
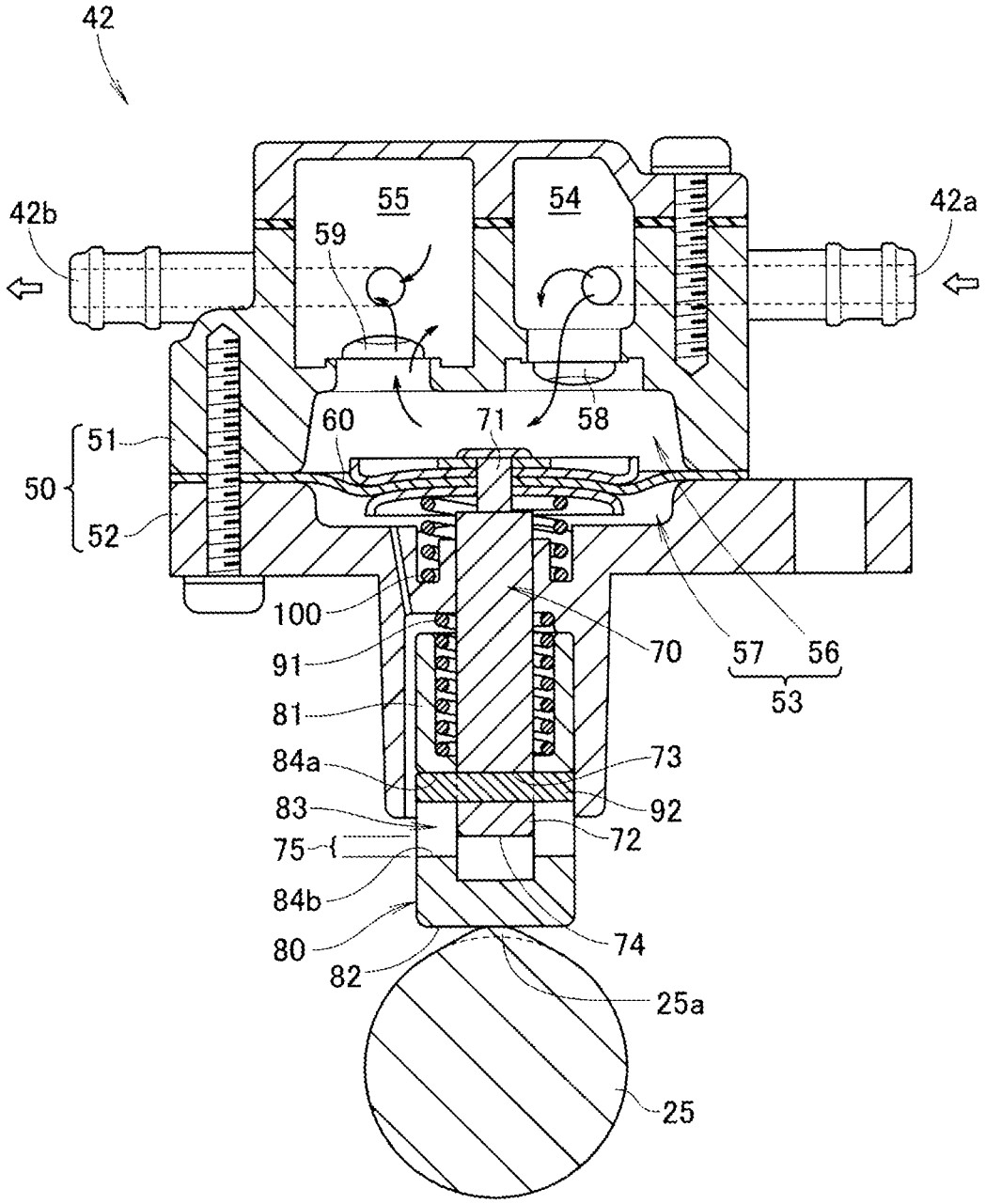
FIG. 4 is a cross sectional view showing the diaphragm type fuel pump for the general purpose engine used in a low pressure application shown in FIG. 1.
Figure 5:
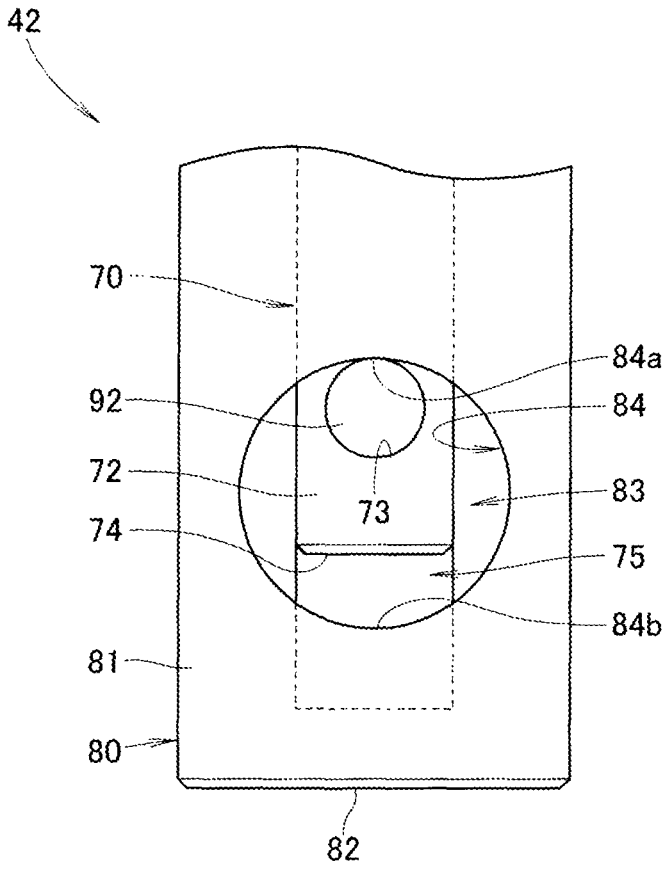
FIG. 5 is an enlarged view showing the other end of a rod and a plunger shown in FIG. 4, as viewed in a longitudinal direction of a first pin.

Next, in the case where the diaphragm type fuel pump 42 for the general purpose engine used as the fuel pump in the low pressure application, as shown in FIGS. 4 and 5, only the first pin 92 is provided, and the second pin 93 shown in FIGS. 1 and 2 are not provided. Further, in this case, a "diaphragm biasing member 100" for biasing the diaphragm 60 from the air chamber 57 to the pump chamber 56 is provided. The other structure is the same as that of the diaphragm type fuel pump 42 used in the high pressure application shown in FIGS. 2 and 3, and detailed description is omitted.

In operation of the fuel pump 42 for use in the low pressure application, the plunger 80 moves back and forth in a reciprocal manner relative to the diaphragm 60 by rotating displacement of the cam 25*a*. Therefore, when the plunger 80 is displaced toward the diaphragm 60, the rod 70 is movable freely in the axial direction relative to the plunger 80. The rod 70 and the diaphragm 60 are displaced elastically toward the pump chamber 56 by the biasing force of the diaphragm biasing member 100. Thereafter, in the case where the plunger 80 is displaced toward the cam 25*a*, the rod 70 and the diaphragm 60 are returned to the cam 25*a* side in opposition to the biasing force of the diaphragm biasing member 100. As a result, by the change of the volume of the pump chamber 56, the fuel suctioned from the intake port 42*a* is discharged to the discharge port 42*b*.

The diaphragm type fuel pump 42 for the general purpose engine used as the fuel pump in the "low pressure" application as described above is the optimum for supplying the fuel to the "carburetor (not shown) for atomizing the fuel utilizing the negative pressure".

As described above, in the embodiment of the present invention, the diaphragm type fuel pump 42 for a general purpose engine can include, in addition to the first pin 92, the second pin 93 which is in parallel to the first pin 92. Regardless of whether the second pin 93 is present or not, the plunger 80 is biased by the plunger biasing member 91 toward the other end 72 of the rod 70. The first pin 92 is contact with the part 84*a* of the edge 84 (one edge 84*a*) of the through hole 83 closer to the diaphragm 60 at all times.

As shown in FIG. 4, in the case where only the first pin 92 is used, the other end 72 of the rod 70 can move in the longitudinal direction of the rod 70 relative to the plunger 80. In this case, the "diaphragm biasing member 100" for biasing the diaphragm 60 from the air chamber 57 toward the pump chamber 56 is provided. Therefore, when the plunger 80 is pushed up toward the diaphragm 60 by the cam 25*a* of the general purpose engine 10, the diaphragm 60 is biased by the diaphragm biasing member 100 toward the pump chamber 56. The resulting discharge pressure of the fuel pump 42 is a relatively low pressure which depends on the biasing force of the diaphragm biasing member 100.

As shown in FIG. 2, in the case where both of the first pin 92 and the second pin 93 are used, the second pin 93 is interposed between the other part 84*b* of the edge 84 (other edge 84*b*) of the through hole 83 closer to the bottom 82 of the plunger 80 and the other end surface 74 of the rod 70, and comes into contact with the other edge 84*b* and the other end surface 74. That is, the second pin 93 is in contact with the other part 84*b* of the edge 84 (other edge 84*b*) of the through hole 83. Movement of the other end 72 of the rod 70 in the longitudinal direction of the rod 70 relative to the plunger 80 is restricted (i.e., locked) by the first pin 92 and the second pin 93. As a result, the rod 70 is directly connected to the plunger 80, regardless of whether or not the diaphragm biasing member 100 (see FIG. 4) is present.

Therefore, when the plunger 80 is pushed up toward the diaphragm 60 by the cam 25*a* of the general purpose engine 10, the diaphragm 60 is forcibly displaced elastically toward the pump chamber 56 by the plunger 80. Therefore, the resulting discharge pressure of the fuel pump 42 is a relatively high pressure which does not depend on the biasing force of the diaphragm biasing member 100.

In this manner, the discharge pressure of the fuel pump 42 can be changed optionally depending on whether or not the second pin 93 (see FIG. 2) is present. Further, simply by selecting the presence or absence of the second pin 93, with the simple structure, the discharge pressure of the fuel pump 42 can be changed very easily. Additionally, even when the discharge pressure of the fuel pump 42 is changed, the shape and the dimensions of the fuel pump 42 remain exactly the same. That is, simply by switching between the fuel pump for use in the low pressure application and the fuel pump for use in the high pressure application, the pump can be used as is, without any modification. Therefore, in the fuel supply line 40 of the general purpose engine 10, it is possible to easily switch between the line having the specifications for the carburetor and the line having the specifications for the electronic control injection apparatus.

Further, by selecting the presence or the absence of the second pin 93, one type of diaphragm type fuel pump 42 can be switched between the low pressure application and the high pressure application. Therefore, improvement in the mass production efficiency is achieved. Consequently, it becomes possible to reduce the cost of the diaphragm type fuel pump 42 for the general purpose engine.

As shown in FIG. 2, preferably, a spacer 94 is fitted between the second pin 93 and an inner bottom 85 of the plunger 80. In this manner, the central portion of the second pin 93 in the longitudinal direction can be supported by the inner bottom 85 (inner bottom surface 85) of the plunger 80 through the spacer 94. Accordingly, it is possible to enhance the bending strength of the second pin 93.

Next, a modification of the diaphragm type fuel pump 42 will be described with reference to FIG. 6. A diaphragm type fuel pump 42A for a general purpose engine according to the modification is different from the fuel pump 42 shown in FIGS. 2 and 3 only in the following points, and has the same structure as the fuel pump 42 in the other points.

The first different point is that a gap 95 is present between the other end surface 74 of the rod 70 and the inner bottom 85 of the plunger 80. A spacer 94A can be fitted into the gap 95.

The second different point is that, by adopting the structure where the spacer 94A is fitted in the gap 95, movement of the other end 72 of the rod 70 in the longitudinal direction of the rod 70 relative to the plunger 80 is restricted by the first pin 92 and the spacer 94A.

In the diaphragm type fuel pump 42 for the general purpose engine according to the modification, it is possible to provide the spacer 94A in addition to the first pin 92. Regardless of whether or not the spacer 94A is present, the plunger 80 is biased toward the other end 72 of the rod 70 by the plunger biasing member 91. The first pin 92 is in contact with the part 84*a* of the edge 84 (one edge 84*a*) of the through hole 83 closer to the diaphragm at all times.

As shown in FIG. 4, in the case where only the first pin 92 is used, the other end 72 of the rod 70 can move in the longitudinal direction of the rod 70 relative to the plunger 80. In this case, the "diaphragm biasing member 100" for biasing the diaphragm 60 from the air chamber 57 to the pump chamber 56 is provided. In the structure, when the plunger 80 is pushed up toward the diaphragm 60 by the cam 25*a* of the general purpose engine 10, the diaphragm 60 is biased toward the pump chamber 56 by the diaphragm biasing member 100. The resulting discharge pressure of the fuel pump 42 is a relatively low pressure which depends on the biasing force of the diaphragm biasing member 100.

Figure 6:
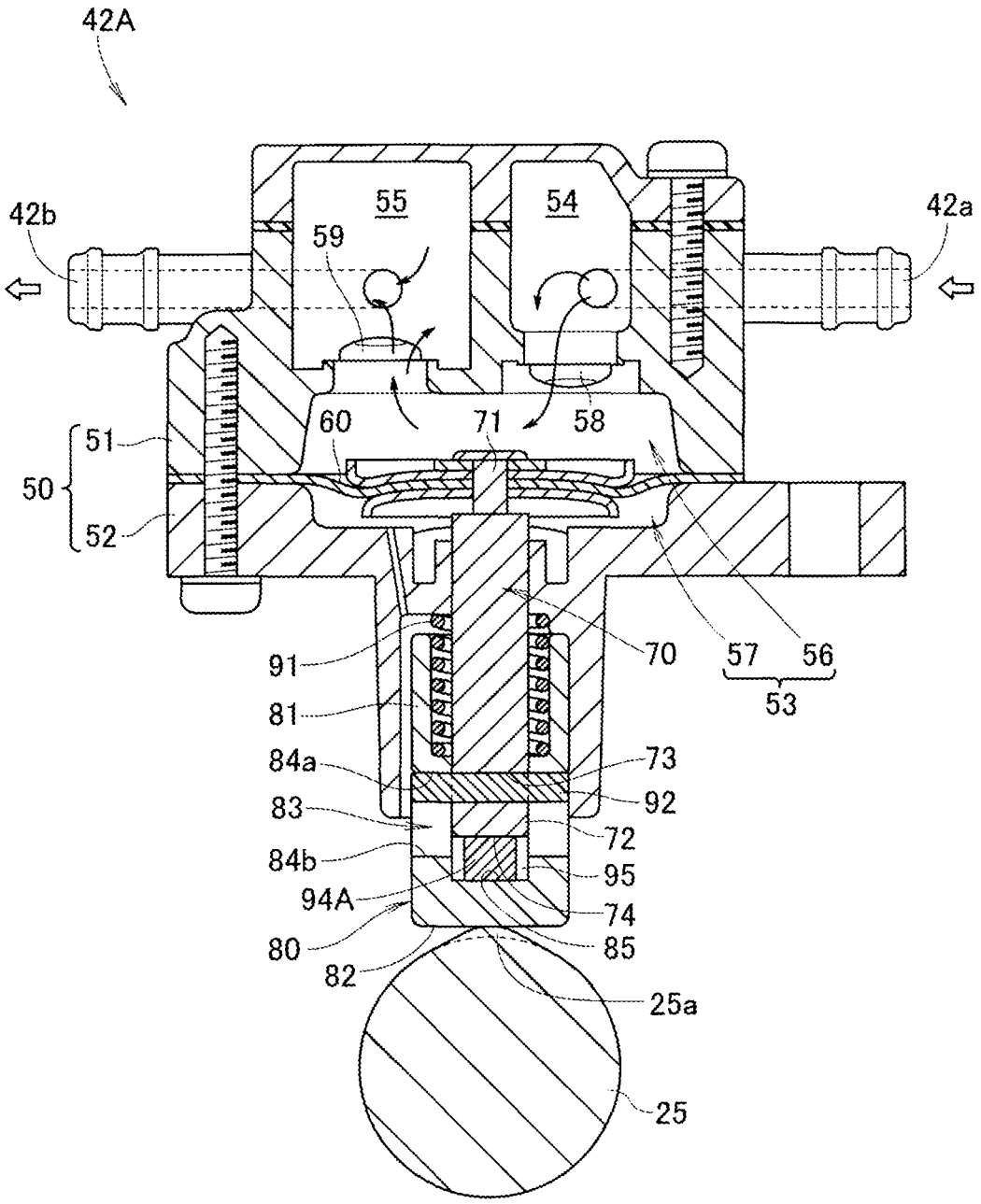
FIG. 6 is a cross sectional view showing the diaphragm type fuel pump for the general purpose engine used in a high pressure application in shown in FIG. 2, according to a modification of the embodiment.

As shown in FIG. 6, in the case where both of the first pin 92 and the spacer 94A are used, the spacer 94A is interposed between the other end surface 74 of the rod 70 and the inner bottom 85 of the plunger 80, while in contact with the other end surface 74 and the inner bottom 85. Movement of the other end 72 of the rod 70 in the longitudinal direction of the rod 70 relative to the plunger 80 is restricted (i.e., locked) by the first pin 92 and the spacer 94A. As a result, the rod 70 is directly connected to the plunger 80, regardless of whether or not diaphragm biasing member 100 (see FIG. 4) is present.

Therefore, when the plunger 80 is pushed up toward the diaphragm 60 by the cam 25*a* of the general purpose engine 10, the diaphragm 60 is forcibly displaced elastically toward the pump chamber 56 by the plunger 80. Therefore, the resulting discharge pressure of the fuel pump 42 is a relatively high pressure which does not depend on the biasing force of the diaphragm biasing member 100.

In this manner, the discharge pressure of the fuel pump 42 can be changed optionally depending on whether or not the spacer 94A is present. Further, simply by selecting the presence or absence of the spacer 94A, with the simple structure, the discharge pressure of the fuel pump 42 can be changed very easily. Additionally, even in the case that the discharge pressure of the fuel pump 42 is changed, the shape and the dimensions of the fuel pump 42 remain exactly the same. That is, simply by switching between the fuel pump for use in the low pressure application and the fuel pump for use in the high pressure application, the pump can be used as is, without any modification. Therefore, in the fuel supply line 40 of the general purpose engine 10, it is possible to easily switch between the line having the specifications for the carburetor and the line having the specifications for the electronic control injection apparatus.

Further, by selecting the presence or the absence of the spacer 94A, the same diaphragm type fuel pump 42 can be switched between the low pressure application and the high pressure application. Therefore, improvement in the mass production efficiency is achieved. Consequently, it becomes possible to reduce the cost of the diaphragm type fuel pump 42 for the general purpose engine.

The diaphragm type fuel pumps 42, 42A for the general purpose engine can be adopted suitably for the general purpose engine of a general purpose machine such as an outboard engine or a work machine.

While the invention has been particularly shown and described with reference to the preferred embodiments, it will be understood that variations and modifications can be effected thereto by those skilled in the art without departing from the scope of the invention as defined by the appended claims.

What is claimed is:

1. A diaphragm type fuel pump for a general purpose engine, the diaphragm type fuel pump comprising:

a housing;

a diaphragm configured to divide a space inside the housing into a pump chamber and an air chamber;

a rod slidably supported by the housing, one end of the rod being coupled to the diaphragm, another end of the rod protruding from the air chamber to outside of the housing;

a plunger positioned concentrically with the other end of the rod and configured to be slidably fitted with respect to the rod; and a plunger biasing member configured to bias the plunger toward the other end of the rod, wherein the other end of the rod includes a first pin extending radially outwardly of the other end;

the plunger includes a bottomed tubular shape having a tubular portion, the other end of the rod being fitted into the tubular portion;

a through hole extends through the tubular portion in a radial direction of the tubular portion;

the through hole is configured to have a size which allows the first pin to be displaced in a longitudinal direction of the rod relative to the through hole;

a part of an edge of the through hole closer to the diaphragm is referred to as one edge, and another part thereof closer to a bottom of the plunger is referred to as another edge;

the first pin is in contact with the one edge;

a gap is formed between the other edge of the through hole and another end surface of the rod for allowing a second pin in parallel to the first pin to be fitted into the gap; and the second pin is fitted into the gap to restrict movement of the other end of the rod in a longitudinal direction of the rod relative to the plunger by the first pin and the second pin.

2. The diaphragm type fuel pump for the general purpose engine according to claim 1, wherein a spacer is fitted between the second pin and an inner bottom of the plunger.

3. A diaphragm type fuel pump for a general purpose engine, the diaphragm type fuel pump comprising:

a housing;

a diaphragm configured to divide a space inside the housing into a pump chamber and an air chamber;

a rod slidably supported by the housing, one end of the rod being coupled to the diaphragm, another end of the rod protruding from the air chamber to outside of the housing;

a plunger positioned concentrically with the other end of the rod and configured to be slidably fitted with respect to the rod; and a plunger biasing member configured to bias the plunger toward the other end of the rod, wherein the other end of the rod includes a first pin extending radially outwardly of the other end;

the plunger includes a bottomed tubular shape having a tubular portion, the other end of the rod being fitted into the tubular portion;

a through hole extends through the tubular portion in a radial direction of the tubular portion;

the through hole is configured to have a size which allows the first pin to be displaced in a longitudinal direction of the rod relative to the through hole;

a part of an edge of the through hole closer to the diaphragm is in contact with the first pin;

a gap is formed between another end surface of the rod and an inner bottom of the plunger, for allowing a spacer to be fitted into the gap; and the spacer is fitted into the gap to restrict movement of the other end of the rod in a longitudinal direction of the rod relative to the plunger by the first pin and the spacer.

* * * * *